US007634912B2

(12) United States Patent
Travis

(10) Patent No.: US 7,634,912 B2
(45) Date of Patent: Dec. 22, 2009

(54) METHODS AND APPARATUS FOR ACTUATOR SYSTEM

(75) Inventor: Robert D. Travis, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 320 days.

(21) Appl. No.: 11/420,361

(22) Filed: May 25, 2006

(65) Prior Publication Data

US 2007/0271922 A1 Nov. 29, 2007

(51) Int. Cl.
*F01B 29/08* (2006.01)

(52) U.S. Cl. ..... 60/632; 60/636

(58) Field of Classification Search ..... 60/632–638
See application file for complete search history.

(56) References Cited

U.S. PATENT DOCUMENTS 3,234,727 A * 2/1966 Filer ..... 60/632
4,422,669 A * 12/1983 Chiba et al. ..... 280/806
6,712,394 B2 * 3/2004 Betz et al. ..... 280/805

* cited by examiner

*Primary Examiner*—Hoang M Nguyen
(74) *Attorney, Agent, or Firm*—The Noblitt Group, PLLC

(57) ABSTRACT

Methods and apparatus for an actuator system according to various aspects of the present invention include a housing; a sleeve having a deformable portion; and a mover for applying force to the sleeve. The sleeve, which is sealed to the housing, is configured to reside and move within the housing. The mover applies a force against a portion of the sleeve, causing the deformable portion to deform and move.

25 Claims, 2 Drawing Sheets

METHODS AND APPARATUS FOR ACTUATOR SYSTEM

FIELD OF INVENTION

Methods and apparatus according to various aspects of the present invention relate to actuators.

BACKGROUND

Actuators, such as those used in missile fuel delivery and other time-critical systems, must satisfy high performance requirements. They must begin operation extremely quickly, thereby minimizing the time-delay between receiving a start signal and beginning to operate. They must also complete actuation quickly, minimizing the time between beginning actuation and completing actuation. To meet these high performance requirements, actuators often employ an explosive device to cause actuation. Unfortunately, the gases generated by the explosive device are often forced out of the actuator housing causing contamination of the fuel or gas being controlled by the actuator. In some cases, this contamination can severely degrade overall system performance. In addition, actuators may have to perform effectively after remaining idle in harsh environments for years or even decades.

Seals can be used to minimize the amount of gas that escapes from a pyro-valve actuator. Seals, however, do not generally work effectively. The problem is exacerbated as the seal ages, causing brittleness and shape distortions. Also, due to the high temperatures that result from the explosion, seals can burn and char. Finally, because many seals require lubrication, the lubrication itself can often act as a contaminant—the very problem the seal is attempting to solve.

Interference fits may be able to minimize the amount of blow-by gas that escapes from the actuator. Unfortunately, these devices tend to be expensive, cause drag in the actuator (degrading the unit's performance), require lubrication, and can often cause damage to the actuator itself through galling of metal-to-metal interfaces.

Finally, actuators comprising bellow systems have been developed to contain any gas blow-by that escapes the device. Bellows, however, generally result in increased cost, size, and complexity of the device. Also, the added complexity of bellows generally diminishes the reliability of the device.

SUMMARY OF THE INVENTION

Methods and apparatus for an actuator system according to various aspects of the present invention include a housing; a sleeve having a deformable portion; and a mover for applying force to the sleeve. The sleeve, which is sealed to the housing, is configured to reside and move within the housing. The mover applies a force against a portion of the sleeve, causing the deformable portion to deform and move.

BRIEF DESCRIPTION OF THE DRAWINGS

Representative elements, operational features, applications and/or advantages of the present invention reside in the details of construction and operation as more depicted, described and claimed. Reference is made to the accompanying drawings, wherein like numerals typically refer to like parts.

Figure 1:
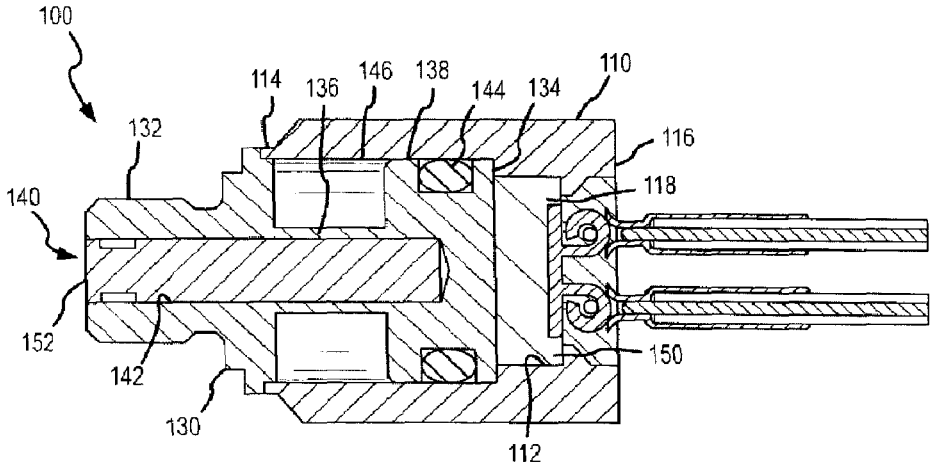
FIG. 1 is a cross-sectional view of an actuator system showing a movable element in a retracted position before activation.

Elements in the figures are illustrated for simplicity and clarity and have not necessarily been drawn to scale. For example, the dimensions of some of the elements in the figures may be exaggerated relative to other elements to help improve understanding of various embodiments of the present invention. Furthermore, the terms "first", "second", and the like herein, if any, are used for distinguishing between similar elements and not necessarily for describing a priority or a sequential or chronological order. Moreover, the terms "front", "back", "top", "bottom", "over", "under", and the like in the description and/or in the claims, if any, are generally employed for descriptive purposes and not necessarily for comprehensively describing exclusive relative position. Any of the preceding terms so used may be interchanged under appropriate circumstances such that various embodiments of the invention may be rendered capable of operation in other configurations and/or orientations than those explicitly illustrated or otherwise described.

DETAILED DESCRIPTION OF EXEMPLARY EMBODIMENTS

The following representative descriptions of the present invention generally relate to exemplary embodiments and the inventor's conception of the best mode, and are not intended to limit the applicability or configuration of the invention in any way. Rather, the following description is intended to provide convenient illustrations for implementing various embodiments of the invention. Changes may be made in the function and/or arrangement of any of the elements described in the disclosed exemplary embodiments without departing from the spirit and scope of the invention.

For example, various representative implementations of the present invention may be applied to any device for controlling blow-by in an actuator. A detailed description of an exemplary application, namely an actuator system, is provided as a specific enabling disclosure that may be generalized to any application of the disclosed system, device, and method for sealed actuators in accordance with various embodiments of the present invention.

Referring to FIGS. 1 through 4, an actuator system 100 according to various aspects of the present invention provides an actuator that facilitates movement while inhibiting unintended transfer of material past the actuator system 100. For example, the actuator system 100 may be configured to contain gas blow-by generated by an explosive actuating device. In one embodiment, the actuator system 100 comprises a housing 110, a sleeve 130, and a mover 150. The housing 110 contains the components of the actuator system 100. The sleeve 130 provides a movable interface between the mover 150 and a movable element 152 to be moved, such as a piston or rod. The mover 150 applies force to the sleeve 130 to move the sleeve 130.

The housing 110 may comprise any suitable housing for containing the components of the actuator system 100, such as a metal, plastic, ceramic, or combination of materials. Additionally, the housing 110 may be configured in any suitable manner. In the present embodiment, the housing 110 comprises an interior wall 112, an open end 114 and a closed end 116. The housing 110 contains the sleeve 130 and the mover 150. The housing 110 is also suitably configured to contain gas or other contaminants that may be associated with the actuator system 100, such as gas and particles that may be generated by an explosive mover 150. In the present embodiment, the housing 110, the sleeve 130, and the movable element 152 are generally cylindrical, though any appropriate shape or configuration may be employed. In an alternative embodiment, an exterior surface of the housing 110 may be configured to engage a tool for manipulating the actuator system 100. For example, the exterior surface of the housing 110 may be hexagonal, for example to engage a wrench.

The sleeve 130 responds to force applied by the mover 150 and transfers the force to and moves the movable element 152. The sleeve 130 is configured to maintain its integrity, i.e., inhibit development of perforations, breaks, or other openings that may allow the passage of contaminants, when the sleeve 130 responds to the force applied by the mover 150. In addition, an immobile portion of the sleeve 130 may be attached to the housing 110 to form a seal.

The sleeve 130 may be configured in any suitable manner to transfer force and movement to the movable element 152. For example, a portion of the sleeve 130 may be configured to slide along the interior wall 112 within the housing 110 upon activation of the mover 150. In the present embodiment, the sleeve 130 comprises a first end 132, a second end 134, and a deformable portion 136. The first end 132 remains immobile, and the second end 134 transfers movement force to the movable element 152. The deformable portion 136 deforms in response to force applied to the second end 134 to facilitate movement of the second end 134 and the movable element 152 with respect to the immobile first end 132.

More particularly, the first end 132 of the sleeve 130 is sealed, for example via a laser weld, an electron beam weld, a fusion weld, or the like, to the open end 114 of the housing 110 and/or a structure attached to the housing 110. The sealed connection between the first end 132 of the sleeve 130 and the housing 110 inhibits gas or other contaminants from entering or exiting the housing 110. In an alternative embodiment, the first end 132 of the sleeve 130 is detachably coupled to the open end 114 of the housing 110, for example using a threaded interface and a gasket or other sealable connection.

The second end 134 of the sleeve 130 is configured to reside and move within the housing 110. An exterior portion 138 of the second end 134 of the sleeve 130 slidably engages the interior wall 112 of the housing 110. The outside diameter of the exterior portion 138 is suitably slightly less than the interior diameter of the interior wall 112 to guide the travel path of the second end 134 and restrict gas flow between the second end 134 of the sleeve 130 and the interior wall 112 of the housing 110.

In one embodiment, the sleeve 130 may comprise multiple elements. For example, referring to FIGS. 3 and 4, the sleeve 130 may comprise a first element 310 and a second element 312. The first element 310 forms the first end 132 and the second element 312 forms the second end 134. In this embodiment, the first element 310 includes a hollow tube 314 disposed within an aperture formed in the second element 312. The hollow tube 314 suitably defines the deformable portion 136 of the sleeve 130.

The sleeve 130 may also include a stop 316 between the second end 134 and the first end 132. The stop 316 suitably controls the compression of the sleeve 130 in response to the mover 150, such as to inhibit excessive compression of the sleeve 130 and/or to more smoothly decelerate the compression of the sleeve 130 as the compression nears completion. The stop 316 may be configured in any suitable manner to selectively control the compression of the sleeve 130. For example, the present stop 316 comprises a skirt around the perimeter of the second end 134 and/or the second element 312. The material and/or structure of the skirt may be selected according to any suitable criteria to facilitate the deceleration and control of the sleeve 130 compression. The stop 316 may also be configured to avoid interfering with the collapse of the deformable portion 136. Further, the stop 316 may be configured to retain the sleeve 130 in the compressed position following compression. For example, the skirt may include one or more catches formed on the exterior surface of the skirt that may engage notches in the interior surface 112 of the housing 110 upon compression to prevent re-expansion of the sleeve 130.

The actuator system 100 may also include additional elements to inhibit fluid transfer between the exterior portion 138 and the interior wall 112. For example, a seal, such as a conventional resilient o-ring 144 or a viscous lubricant, may be disposed between the exterior portion 138 and the interior wall 112 to further restrict gas flow between the exterior portion 138 of the second end 134 of the sleeve 130 and the interior wall 112 of the housing 110.

The deformable portion 136 of the sleeve 130 is configured to deform when sufficient force is applied against the sleeve 130. The deformation of the deformable portion 136 allows the second end 134 to move relative to the first end 132. In the present embodiment, the deformable portion 136 is configured to collapse by bending outward radially away from the movable element 152. By bending away from the movable element 152, the deformable portion 136 does not interfere with the movement of the movable element 152. In addition, the deformable portion 136 is suitably configured to bend without losing integrity of the material. In the present embodiment, the deformable portion 136 of the sleeve 130 provides stand-off for the actuator system 100, which allows pressure to build behind the second end 134 of the sleeve 130 before the deformable portion 136 starts to deform and the actuator system 100 begins to operate.

The deformable portion 136 of the sleeve 130 may comprise any suitable material and be configured in any appropriate manner for bending without losing integrity. For example, the deformable portion 136 may comprise a metal that is selectively softened around a selected area and geometrically configured to promote the desired collapse of the deformable portion 136 in a predetermined manner in response to force applied to the second end 134. In one embodiment, the deformable portion may be softened by annealing, which may alter the strength of selected portions of a material by changing its microstructure, for example by heating and cooling the material. In the present embodiment, the metal deformable portion 136 may be configured to collapse and maintain the seal by annealing selected areas of the deformable portion 136, for example using a process of RF induction to band anneal selected areas around the sleeve 130. Any suitable form of annealing may be applied to form the deformable portion 136, such as laser annealing and/or electron beam annealing. Annealing increases the ductility of the metal to promote collapse upon application of a selected force. Annealing also facilitates selection of a desired size for the deformable portion 136 of the sleeve 130 for particular applications requiring specific stroke lengths of the actuator system 100.

Further, the deformable portion 136 may be configured to deform upon application of a threshold amount of force. For example, the amount and extent of the annealing may be adjusted to affect the load sustainable by the deformable portion 136 prior to deforming. In addition, the physical structure of the deformable portion 136, such as the thickness of the material or the surface of the deformable portion 136, may be selected and/or modified to achieve a threshold force before deforming.

The movable element 152 moves upon operation of the actuator system 100 and allows the actuator system 100 to be coupled to and/or apply force to other systems. The movable element 152 may comprise any suitable movable element for moving and applying force to other systems, and may be configured in any suitable manner and comprise any appropriate materials for achieving the relevant function. In the present embodiment, the movable element 152 comprises a substantially rigid rod disposed into the aperture 140 formed in the first end 132 of the sleeve 130 that passes through the deformable portion 136 of the sleeve 130 and into the second end 134 of the sleeve 130. The movable element 152 is suitably configured so that the exterior wall 154 of the movable element 152 slidably engages the interior wall 142 of the sleeve 130.

Figure 2:
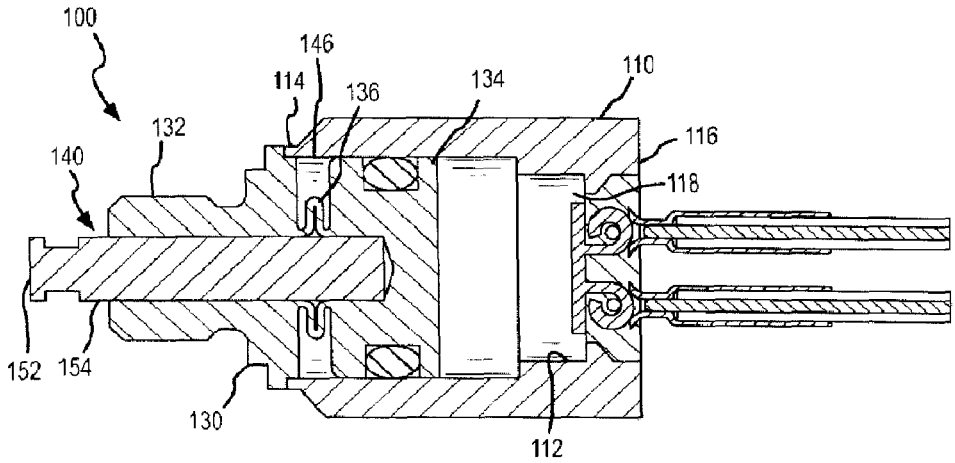
FIG. 2 is a cross-sectional view of the actuator system showing the movable element in an extended position following activation.
Figure 3:
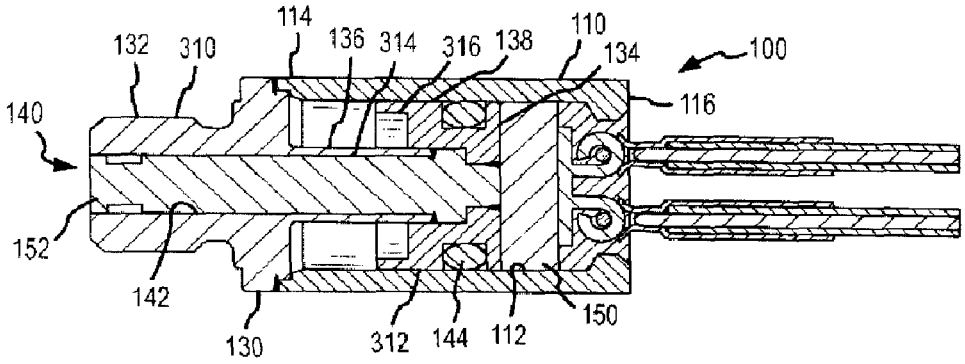
FIG. 3 is a cross-sectional view of an alternative actuator system showing the movable element in the retracted position before activation.
Figure 4:
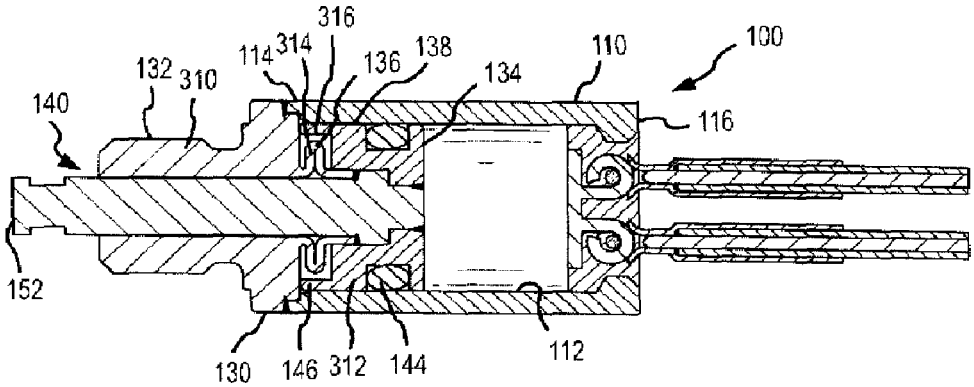
FIG. 4 is a cross-sectional view of the alternative actuator system showing the movable element in the extended position following activation.

In one embodiment, referring to FIGS. 1 and 2, the movable element 152 slidably engages the interior wall 142 of the sleeve 130 proximate the first end 132 and the deformable portion 136 of the sleeve 130. The movable element 152 may abut the second end 134 of the sleeve 130. Alternatively, referring to FIGS. 3 and 4, the movable element 152 may be configured to engage the interior wall 142 of the sleeve 130, for example via an annular protrusion extending radially from the surface of the movable element 152 and into a space formed between the end of the hollow tube 314 and the interior surface of the second element 312. The movable element 152 may also extend through the second element 312 to the second end 134. The seam between the movable element 152 and the second element 312 may be sealed, such as by weld material. The movable element 152 may be fixed in position, such as via welds between the annular protrusion and the end of the hollow tube 314 and/or the interior surface of the second element 312. The movable element 152 may extend from the first end 132 of the sleeve 130 when overall length of the sleeve 130 decreases when the mover 150 applies force to the second end 134.

The movable element 152 may be fixed to the second end 134, for example via a laser weld, an electron beam weld, a fusion weld, or the like so that the movable element 152 remains connected to the sleeve 130 following actuation, or may abut the second end 134 so that the movable element 152 is released from the sleeve 130 following actuation, effectively shooting the movable element 152 out of the sleeve 130. Additionally, the movable element 152 may be omitted. For example, the actuator system 100 may operate by changing the fluid pressure in a system proximate the first end 132 of the sleeve 130 by changing the volume in the system. No movable element 152 would be required, as the compression of the sleeve 130 and the volume defined by the interior wall of the sleeve 130 may be sufficient to cause changes in fluid pressure.

The mover 150 applies force to the second end 134 of the sleeve 130 when the actuator system 100 is operated. The mover 150 may comprise any suitable mechanism for applying force to the second end 134. For example, the mover 150 may comprise an explosive material and a detonating mechanism. In the present embodiment, the mover 150 comprises an explosive proximate an interior portion 118 of the closed end 116 of the housing 110. The explosive is connected to the detonating mechanism, such as wires for receiving an electrical signal, a fuse, or a percussion surface for receiving an impact. Alternatively, the mover 150 may comprise mechanical or hydraulic systems to apply force to the second end 134. The mover 150 is suitably sealed within the housing 110, for example to ensure increasing pressure upon detonation.

The actuator system 100 begins operation with the deformable portion 136 fully extended. When the actuator system 100 is operated, the mover 150 exerts force upon the second end 134 of the sleeve 130. For example, the explosive may generate rapidly expanding gas, increasing gas pressure within the housing 110. The increased gas pressure applies force to the second end 134 of the sleeve 130, which transfers the force along the length of the sleeve 130. As the force increases, the deformable portion 136 begins to deform and the second end 134 begins to move. As the deformable portion 136 of the sleeve 130 collapses, the second end 134 pushes the movable element 152 out of the sleeve 130.

As force is applied along the length of the sleeve, the deformable portion 136 of the sleeve 130 collapses into a cavity that may operate as a containment area 146 between the sleeve 130 and the housing 110. The containment area 146 may receive and retain any gas blow-by that may flow between the exterior portion 138 of the second end 134 of the sleeve 130 and the interior wall 112 of the housing 110. The seal between the first end 132 and the housing 110 and the surface of the deformable portion 136 retains the gas in the housing 110.

In the foregoing specification, the invention has been described with reference to specific exemplary embodiments. Various modifications and changes may be made without departing from the scope of the present invention as set forth in the claims below. The specification and figures are to be regarded in an illustrative manner, rather than a restrictive one. Accordingly, the scope of the invention should be determined by the claims and their legal equivalents rather than by merely the examples described above.

For example, the steps recited in any method or process claims may be executed in any order and are not limited to the specific order presented in the claims. Additionally, the components and/or elements recited in any apparatus claims may be assembled or otherwise operationally configured in a variety of permutations to produce substantially the same result as the present invention and are accordingly not limited to the specific configuration recited.

Benefits, other advantages and solutions to problems have been described above with regard to particular embodiments. Any benefit, advantage, solution to problem or any element that may cause any particular benefit, advantage or solution to occur or to become more pronounced are not to be construed as critical, required or essential features or components of any or all the claims.

The terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles.

The invention claimed is:

1. An actuator system, comprising:

a housing, comprising:

an interior wall; and an open end;

a sleeve, comprising:

a first end, comprising an exterior portion sealed to the open end of the housing;

a second end, comprising an exterior portion that slides in response to a selected threshold force along the interior wall of the housing; and a deformable portion between the first end and the second end and configured to deform in response to the selected threshold force; and a mover engaging the second end of the sleeve and configured to apply the selected threshold force to the second end of the sleeve, wherein the selected threshold force originates within the housing and causes the deformation.

2. The actuator system of claim 1, wherein the deformable portion of the sleeve comprises a portion of an exterior surface of the sleeve defining at least a part of a cavity.

3. actuator system of claim 1, wherein the housing and the sleeve define a cavity between the first end and the second end of the sleeve.

4. The actuator system of claim 1, wherein the deformable portion comprises a selectively softened metal.

5. The actuator system of claim 1, wherein the deformable portion comprises an annealed material.

6. The actuator system of claim 5, wherein the annealed material is band annealed.

7. The actuator system of claim 5, wherein the annealed material is induction annealed.

8. The actuator system of claim 5, wherein the annealed material is RF induction annealed.

9. The actuator system of claim 1, wherein:

the deformable portion comprises a cylinder having a longitudinal axis; and the deformable portion is configured to bend radially away from the longitudinal axis.

10. The actuator system of claim 1, wherein the mover comprises an explosive.

11. An actuator system comprising:

a substantially cylindrical housing, comprising:

an interior wall;

an open end; and a closed end;

a substantially cylindrical sleeve comprising:

a first end, comprising an exterior portion sealed proximate the open end of the housing and defining a first portion of a cavity;

a second end, comprising an exterior portion that slides in response to a selected threshold force along the interior wall of the housing and defines a second portion of the cavity;

a hollow interior portion; and a deformable portion between the first end and the second end, wherein a surface of the deformable portion defines a third portion of the cavity and the deformable portion is configured to deform in response to application of the selected threshold force a movable element disposed within the hollow interior portion of the sleeve; and an explosive mover disposed within the housing, adjacent the second end of the sleeve, and configured to apply the selected threshold force to the second end of the sleeve.

12. The actuator system of claim 11, wherein the deformable portion comprises a selectively softened metal.

13. The actuator system of claim 11, wherein the deformable portion comprises an annealed material.

14. The actuator system of claim 13, wherein the annealed material is band annealed.

15. The actuator system of claim 13, wherein the annealed material is induction annealed.

16. The actuator system of claim 13, wherein the annealed material is RF induction annealed.

17. The actuator system of claim 11, wherein:

the deformable portion comprises a cylinder having a longitudinal axis; and the deformable portion is configured to bend radially away from the longitudinal axis.

18. A method of moving an element, comprising:

providing a housing, comprising:

an interior wall; and an open end;

providing a sleeve comprising a hollow interior to receive the element comprising:

a first end comprising an exterior portion sealed to the open end of the housing;

a second end that slides in response to a selected threshold force along the interior wail of the housing; and a deformable portion between the first end and the second end;

applying the selected threshold force upon the second end of the sleeve; and deforming the deformable portion in response to the selected threshold force.

19. The method of claim 18, further comprising providing a cavity within the housing for receiving a blow-by gas passing between the second end of the sleeve and the interior wail of the housing.

20. The method of claim 18, wherein the deformable portion comprises a selectively softened metal.

21. The method of claim 18, wherein the deformable portion comprises an annealed material.

22. The method system of claim 21, wherein the annealed material is band annealed.

23. The method system of claim 21, wherein the annealed material is induction annealed.

24. The method system of claim 21, wherein the annealed material is RF induction annealed.

25. The method of claim 18, wherein deforming the deformable portion comprises bending the deformable portion radially away from a longitudinal axis of the sleeve.

* * * * *

UNITED STATES PATENT AND TRADEMARK OFFICE

CERTIFICATE OF CORRECTION

PATENT NO. : 7,634,912 B2
APPLICATION NO. : 11/420361
DATED : December 22, 2009
INVENTOR(S) : Robert D. Travis It is certified that error appears in the above-identified patent and that said Letters Patent is hereby corrected as shown below:

In column 7, claim 3, line 23, before the word "actuator" insert --The--;

Signed and Sealed this

Twenty-third Day of February, 2010

David J. Kappos

David J. Kappos
*Director of the United States Patent and Trademark Office*